United States Patent [19]

Dunning, Jr. et al.

[11] 4,090,935

[45] May 23, 1978

[54] PROCESS FOR RECOVERING SILVER, COPPER AND STAINLESS STEEL FROM SILVER BRAZED STAINLESS STEEL SECTIONS

[75] Inventors: Beverly W. Dunning, Jr., Adelphi; D. Harry Chambers, Catonsville, both of Md.

[73] Assignee: The United States of America as represented by the Secretary of the Interior, Washington, D.C.

[21] Appl. No.: 814,959

[22] Filed: Jul. 12, 1977

[51] Int. Cl.[2] ..... C25F 5/00; C25C 1/00; C25C 1/12

[52] U.S. Cl. ..... 204/146; 204/106; 204/109

[58] Field of Search ..... 204/146, 109, 112, 106

[56] References Cited

U.S. PATENT DOCUMENTS

| | | | |
|---|---|---|---|
| 1,996,985 | 4/1935 | Truthe | 204/109 |
| 3,616,332 | 10/1971 | Miller | 204/109 |
| 3,819,494 | 6/1974 | Fountain | 204/146 |
| 3,912,603 | 10/1975 | Mietens et al. | 204/146 |
| 3,958,984 | 5/1976 | Fountain | 204/146 |

*Primary Examiner*—T. M. Tufariello
*Attorney, Agent, or Firm*—William S. Brown; Donald A. Gardiner

[57] ABSTRACT

An electrolytic refining process for recovering silver, copper and stainless steel from stainless steel honey comb sections from military aircraft brazed with a silver based brazing compound, the brazed sections comprising 5 to 30 weight percent silver and 2 to 15 weight percent copper, the balance comprising stainless steel.

14 Claims, 1 Drawing Figure

Figure 1:
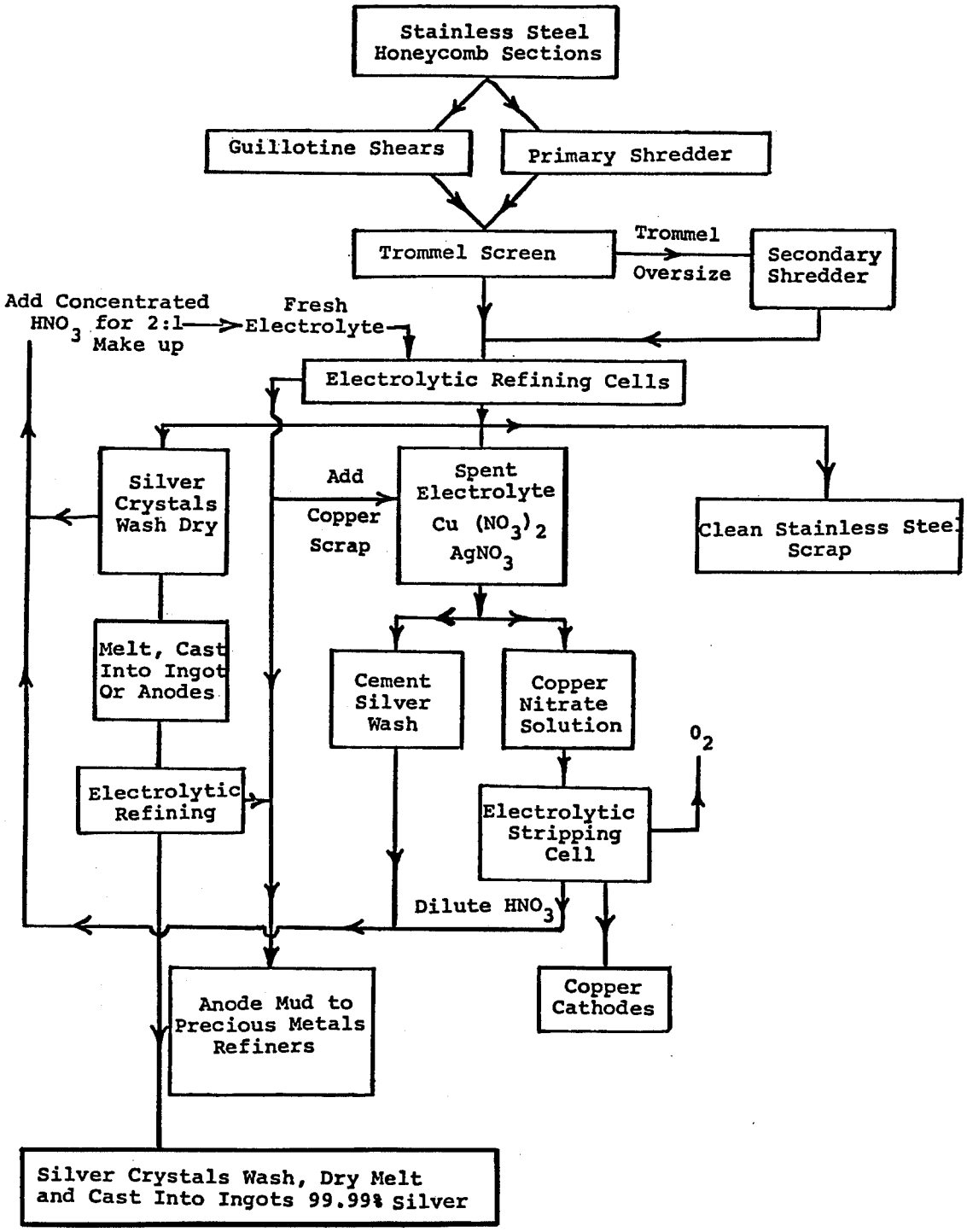

PROCESS FOR RECOVERING SILVER, COPPER AND STAINLESS STEEL FROM SILVER BRAZED STAINLESS STEEL SECTIONS

BACKGROUND OF THE INVENTION

The present invention relates to a process for recovering silver and other metal from stainless steel sections from military aircraft which are brazed with a silver based brazing compound.

It is necessary in supersonic military aircraft that certain parts including flaps, ailerons and engine supporting struts are made of stainless steel rather than aluminum and the other metals and alloys used in the rest of the aircraft because of the high temperatures and stresses to which they are subjected. The stainless steel sections comprise contoured outer sheets with inner support fabricated as honeycomb sections. The honeycomb sections are brazed to the contoured outer sheets with a silver based brazing compound.

When these military aircraft are declared obsolete and discarded for scrap the silver-brazed stainless steel sections are separated from the rest of the aircraft for separate recovery of the metals therein or other scrapping procedures. These silver brazed stainless steel sections contain approximately 5 to 30 weight percent silver and 2 to 15 weight percent copper, balance stainless steel.

Previous methods used for electrolytic recovery of silver have not been able to be used to recover silver from metals containing low percentages of silver. For example, the Moebius cell needs a silver concentration in the anodes of greater than 95% and the Thum or Balbach systems can accept any refinable metal whose silver content exceeds 75%. (Non-Ferrous Extractive Metallurgy in the U.K., W. Ryan (Ed.) 1968).

The Thum and Balbach systems further suffer from the disadvantage that the anode baskets need to be lined with fabric. This fabric traps the anode mud but also increases the cell voltage so that part of the stainless steel would dissolve as well as the silver.

Since some obsolete supersonic military aircraft contain approximately 300 lb. of silver, a new and econominal process is needed for its recovery. Subsonic military aircraft previously used do not generally contain sections of similar metal content. An exception is the flame cone assembly found on some jet engines.

It is therefore an object of the present invention to provide a method for recovering silver from stainless steel honeycomb sections brazed with silver based brazing compound which is substantially free of the disadvantages of the prior art.

Another object of the present invention is to recover silver from silver brazed stainless steel sections when the silver is present as about 5 to 30 weight percent of the sections.

A further object of the present invention is to provide a commercially successful economical process for recovering metals from silver brazed stainless steel sections of obsolete supersonic military aircraft.

Yet another object of the present invention is to provide a process using an anode basket that does not need to be lined with fabric so that the stainless steel sections are left undissolved but stripped of braze in the anode basket.

DESCRIPTION OF THE INVENTION

FIG. 1 shows a flow diagram for the process of this invention.

The stainless steel used in making sections such as flaps, ailerons and engine supporting struts of supersonic military aircraft is generally a magnetic stainless steel such as "17-7 PH" martensitic stainless steel.

The brazing compounds used for fabricating these sections typically comprise by weight 70 to 92% silver and 8 to 30% copper with 1% palladium added optionally.

These parts made from stainless steel are readily removed from the aircraft.

The process used to recover the silver, copper and stainless steel from the silver brazed stainless steel honeycomb sections consists of the following steps:

First the silver brazed stainless steel honeycomb sections are sheared to make pieces of 10 to 12 inches maximum dimension.

Then the pieces produced are shredded to make smaller pieces of 1.5 inches maximum dimension to expose the brazed joints.

Then these smaller pieces are screened using a shaker screen to eliminate pieces of a size to pass through 30 mesh per inch screen.

These first three steps describe comminuting the sections to produce pieces of a size suitable for use in the process. Pieces which are too large will not fit in the anode baskets of the refining cell nor will the brazed joints be adequately exposed for efficient electrolysis. Pieces which are smaller than 0.02 inch maximum diameter may fall through the mesh of the anode baskets adding unnecessarily to the anode mud in the refining cell. The pieces of silver brazed stainless steel section obtained from the shaker screen are placed in a cylindrical stainless steel 30 mesh per inch anode basket located in an electrolytic refining cell, the anode basket being encircled by a cylindrical sheet stainless steel cathode with a one inch gap between the wall of the anode basket and the cathode, the electrolytic cell containing as electrolyte a solution of copper nitrate of concentration 15 to 30 g. Cu/liter and silver nitrate of concentration 15 to 35 g. Ag/liter.

A direct current of 30 amps per square foot of cathode and 0.1 to 5 volts is passed through the electrolytic refining cell whereby silver crystals are deposited on the cathode.

The anode basket is rotated at 0.5 to 5 revolutions per minute to circulate the electrolyte during the process to enable more efficient migration of silver ions to the cathode. The silver crystals deposited on the cathode are removed by scraping. This is carried out advantageously as described in our pending application mentioned above by having epoxy coated wooden scrapers attached to the outside of the rotating anode basket. As the anode basket rotates, the cylindrical cathod is scraped of the silver crystals as they build up on the cathode, the silver crystals falling into a cylindrical basket below the anode basket with a diameter of at least that of the cylindrical cathode. Thus by this rotation of the anode basket, circulation of the electrolyte and simultaneous scraping of the cathode takes place and the electrolysis process is allowed to proceed efficiently. As the electrolyis proceeds the concentration of copper ions in the electrolyte increases and the concentration of silver ions in the electrolyte decreases. A portion of the electrolyte is periodically removed from the cell and replaced with fresh silver nitrate solution to restore the concentrations of silver and copper ions in the electrolyte to those originally present.

The silver crystals which are deposited in the collecting basket are washed and dried and separated magnetically from stainless steel fines which may be present. These silver crystals are 97 to 99.9% pure and can be further purified to 99.99% purity by conventional methods.

The stainless steel sections left in the anode basket are washed and dried and may be recycled for reuse.

The spent electrolyte which is periodically removed from the refining cell is treated to recover its silver and copper content. Copper scrap is first added to the spent electrolyte to precipitate silver crystals, leaving a copper nitrate solution. This copper nitrate solution is refined electrolytically by conventional methods in which copper is deposited at the cathode, thus recovering the metal leaving nitric acid. The silver crystals which are precipitated from the spent electrolyte are used together with the nitric acid left from removing the copper from the spent electrolyte for making fresh silver nitrate solution which is added to the electrolyte solution to replace the spent electrolyte which is withdrawn.

The anode mud which collects at the bottom of the refining cell can be purified conventionally to recover palladium, silver and stainless steel fines.

The invention is further illustrated by the following examples in which all parts and percentages are by weight unless otherwise indicated. These non-limiting examples are illustrative of certain embodiments designed to teach those skilled in the art how to practice the invention and to represent the best mode contemplated for carrying out the invention.

EXAMPLES 1-4

The process was carried out in a rectangular glass cell containing 190 ml. of electrolyte, a stainless steel cathode with an exposed surfce of 1 square inch and an anode basket of dimensions 3 $\frac{1}{8}$ × 1 $\frac{3}{4}$ × $\frac{1}{2}$ inch fabricated from stainless steel screen. All tests were performed at room temperature with a cathode current density of 30 amperes per square foot. In all the tests the cathode current efficiency approached 100%. The results of the electrolysis are shown in Table 1.

TABLE 1

Operating data from small silver electrorefining tests

| Test number | 1 | 2 | 3 | 4 |
|---|---|---|---|---|
| Electrolyte: | | | | |
| Ag (g/l) | 30 | 30 | 20.5 | 30 |
| Cu (g/l) | 20 | 20 | 25 | 20 |
| pH | 5.0 | 5.0 | 1.5 | 3.0 |
| Anode charge (g) | 32.5 | 25.9 | 25.6 | 26.1 |
| Voltage across cell (volts) | 0.75 to .98 | 0.75 to .90 | 0.75 to 1.00 | 0.55 to 1.00 |
| Duration of electrolysis (hrs) | 3.83 | 5.33 | 5.83 | 6.0 |
| Electrolyte after electrolysis: | | | | |
| Ag (g/l) | 21.3 | 20.6 | 11.1 | 18.7 |
| Cu, estimated (g/l) | 25.0 | 25.0 | 31.5 | 26.7 |
| pH | 5.0 | 1.5 | 1.5 | 3.0 |
| Residual charge (g) | 29.9 | 22.5 | 21.4 | 21.9 |
| Ag produced (g) | 3.5 | 4.3 | 4.8 | 5.1 |
| Portion of Ag product derived from aircraft honeycomb, calculated (percent) | 58 | 56 | 60 | 58 |

Table 2 shows a spectrographic analysis of the silver product from Examples 1-4, showing that the silver from the cell is 99.32 - 99.93% pure, and contained no gold or palladium.

TABLE 2

Spectrographic analysis of silver product for impurity elements

| Element | Range, percent | | | Element | Range, percent | | |
|---|---|---|---|---|---|---|---|
| Al | 0.001 | - | 0.01 | Mn | 0.0003 | - | 0.003 |
| Cr | .003 | - | .03 | Mo | .01 | - | .1 |
| Cu | .03 | - | .3 | Ni | .0003 | - | .003 |
| Fe | .01 | - | .1 | Si | .01 | - | .1 |
| Mg | .00003 | - | .0003 | Sn | .003 | - | .03 |

The anode mud from Examples 1-4 was analysed spectrographically to show the trace metals present. The gold and palladium which would be recovered were found only in the anode mud and not in the silver.

TABLE 3

Spectrographic analysis of material washed from the anode charge at the end of one test

| Element | Range, percent | | | Element | Range, percent | | |
|---|---|---|---|---|---|---|---|
| Al | 0.1 | - | 1.0 | Mo | 0.03 | - | 0.3 |
| Au | .001 | - | .01 | Ni | .01 | - | .1 |
| Bi | .003 | - | .03 | Pb | .01 | - | .1 |
| Cr | .3 | - | 3.0 | Pd | .01 | - | .1 |
| Cu | 1.0 | - | 10.0 | Si | .1 | - | 1.0 |
| Fe | 1.0 | - | 10.0 | Sn | .03 | - | .3 |
| Mg | .03 | - | .3 | Ti | .01 | - | .1 |
| Mn | .01 | - | .1 | Zn | .003 | - | .03 |

In Table 4 a spectrographic analysis of the anode charge after electrolysis is shown. Although approximately 5% silver remained in the honeycomb section this amount can probably be reduced by longer electrolysis.

TABLE 4

Spectrographic analysis of stainless steel aircraft honeycomb parts after one test

| Composition range, percent | | | Metals found: Thick skin | Thin skin | Honeycomb |
|---|---|---|---|---|---|
| >10 | | | Cr, Fe | Cr, Fe | Cr, Fe |
| 1.0 | - | 10.0 | Ni | Ni | Ag[3], Al, Ni |
| .3 | - | 3.0 | Al | Al | Mn |
| .1 | - | 1.0 | Mn, Si | Ag[2], Mn, Mo, Si | Cu, Mo, Si |
| .03 | - | .3 | Co, Cu, Mo | Co, Cu | Co |
| .01 | - | .1 | Ti | Sn | Sn, Ti |

TABLE 4-continued

| Composition range, percent | Spectrographic analysis of stainless steel aircraft honeycomb parts after one test — Metals found: Thick skin | Thin skin | Honeycomb |
|---|---|---|---|
| .003 - .03 | Sn, V | Ti, V | Pb, V |
| .001 - .01 | Ag[1], Pb | Pb | Cd |
| .0003 - .003 | Mg | Mg | Mg |

[1]More accurate estimate 0.0034 percent.
[2]More accurate estimate 0.425 percent.
[3]More accurate estimate 5.1 percent.

EXAMPLE 5

Silver brazed, stainless steel aileron sections from a supersonic military aircraft were sheared to make pieces of twelve inches maximum dimension, and then shredded to make pieces of 1.5 inches maximum dimension. The pieces were screened on a thirty mesh per inch screen, and the anode basket from the electrolytic refining cell was filled with pieces from those left on the screen. The anode basket was made from thirty mesh per inch stainless steel and was of cylindrical configuration. The electrolytic refining cell used contained this anode basket, which was encircled by a cylindrical sheet stainless steel cathode spaced one inch away from the wall of the anode basket. The electrolytic refining cell contained as electrolyte a solution of copper nitrate of concentration 20 g. of copper/liter and silver nitrate of concentration 30 g. of silver/liter. The refining was carried out by passing a direct current of 30 amps/sq. ft. of cathode and 0.1 to 5 volts through the cell. The anode basket was rotated at 0.5 to 5 revolutions per minute to circulate the electrolyte. A plastic coated wooden scraper was attached to the anode basket and as the anode basket rotated, the scraper scraped silver crystals from the cathode, which dropped into a basket lying at the bottom of the refining cell. These silver crystals were washed and dried and magnetically separated from any stainless steel fines which may have dropped into the basket. These silver crystals of 95 to 99% purity were further purified by conventional methods to a 99.9% purity. The stainless steel in the anode basket was washed and dried. Copper scraps were added to the spent electrolyte from the electrolytic refining cell to precipitate the silver, leaving a copper nitrate solution. This copper nitrate solution was used as the electrolyte in a refining cell and copper was deposited at the cathode. The anode mud, which collected on the bottom of the refining cell beneath the basket in which the silver was collected was purified to recover palladium, silver and stainless steel fines.

Although the invention has been described in considerable detail with reference to certain preferred embodiments thereof, it will be understood that variations and modifications can be effected within the spirit and scope of the invention as described above and as defined in the appended claims.

What is claimed is:

1. A process for recovering silver, copper and stainless steel from sections of military aircraft comprising stainless steel sections wherein countoured outer sections and inner sections of honeycomb configuration are brazed together with silver based brazing compound, the process comprising the steps of:

I. Comminuting the articles to obtain sections with exposed brazed joints,

II. Placing the sections obtained in step I in an anode basket in an electrolytic refining cell comprising an anode basket, a cathode and an electrolyte, III. Passing a direct current through the refining cell whereby silver crystals are deposited on the cathode, copper is left in the electrolyte and stainless steel is left in the anode basket, IV. Purifying the silver crystals, V. Electrolytically depositing the copper from the spent electrolyte, VI. Washing and drying the stainless steel left in the anode basket.

2. A process of claim 1 wherein the stainless steel members comprise magnetic stainless steel.

3. A process of claim 1 wherein the silver brazing compound comprises by weight 70 to 92% silver, balance essentially copper.

4. A process of claim 3 wherein the silver brazing compound comprises additionally by weight 1% palladium.

5. A process of claim 1 wherein the stainless steel members comprise "17-7PH" martensitic stainless steel.

6. A process of claim 1 wherein the silver content of the silver brazed stainless steel articles is 5 to 30%.

7. A process of claim 1 wherein the anode baskets comprise 30 mesh per inch stainless steel screen.

8. A process of claim 1 wherein the electrolyte contains 15 to 30 g. Cu/liter and 15 to 35 g. Ag/liter.

9. A process of claim 1 wherein the anode basket is rotated to circulate the electrolyte.

10. A process of claim 1 wherein the direct current passed through the refining cell is 30 amps per square foot of cathode.

11. A process of claim 1 wherein the direct current passed through the refining cell is 0.1 to 5 volts.

12. A process of claim 1 wherein stainless steel fines are magnetically separated from the silver crystals.

13. A process of claim 1 wherein the silver crystals are purified to 99.99% purity.

14. A process for recovering silver, copper and stainless steel from silver brazed stainless steel honeycomb sections brazed with a silver based brazing compound containing an average of approximately 5 to 30 weight percent silver and 2 to 10 weight percent copper based on the weight of the stainless steel sections comprising the steps of:

I. Shearing the silver brazed stainless steel honeycomb sections to make pieces of 10 to 12 inches maximum dimension.

II. Shredding the pieces produced in Step I to make smaller pieces of 1.5 inches maximum dimension to expose the brazed joints.

III. Screening the pieces produced in Step II using a shaker screen to eliminate pieces of size to pass through a 30 mesh per inch screen.

IV. Placing the pieces produced in Step III in a basket located in an electrolytic refining cell, the anode basket being encircled by a cylindrical sheet stainless steel cathode with a one inch gap between the wall of the anode basket and the cathode, the electrolytic refining cell containing as electrolyte a solution of copper nitrate of concentration 20 g. Cu/liter and silver nitrate of concentration 30 g. Ag/liter.

V. Passing a direct current of 30 amps per square foot of cathode, and 0.1 to 5 volts through the electrolytic refining cell, whereby silver crystals are deposited on the cathode.

VI. Rotating the anode basket to circulate the electrolyte during the process.

VII. Removing the silver crystals deposited on the cathode by scraping.

VIII. Washing and drying the silver crystals.

IX. Magnetically separating the silver crystals from stainless steel fines.

X. Washing and drying the stainless steel in the anode basket.

XI. Adding copper scrap to the spent electrolyte from the electrolytic refining cell to precipitate the silver and leaving a copper nitrate solution.

XII. Electrolytically depositing the copper from the copper nitrate solution.

XIII. Purifying the anode mud to recover palladium, copper fines and stainless steel fines.

* * * * *